US007316034B1

(12) United States Patent
Berry et al.

(10) Patent No.: US 7,316,034 B1
(45) Date of Patent: Jan. 8, 2008

(54) AESTHETICIAN'S ABSORBENT FINGER COVER

(76) Inventors: Janiene Marie Berry, 1545 N. 14th Ter., Hollywood, FL (US) 33020; Antal Preiner, 1545 N. 14th Ter., Hollywood, FL (US) 33020

( * ) Notice: Subject to any disclaimer, the term of this patent is extended or adjusted under 35 U.S.C. 154(b) by 0 days.

(21) Appl. No.: 11/419,608

(22) Filed: May 22, 2006

(51) Int. Cl.
*A41D 13/08* (2006.01)

(52) U.S. Cl. ..... 2/21; 223/101; 602/22; 132/73

(58) Field of Classification Search ..... 2/21, 2/159–160, 161.1, 161.6, 161.3, 161.8, 163, 2/167–168, 161.5; 128/880; 223/101; 294/25; 602/22; 132/73, 73.5, 319, 75, 200, 285
See application file for complete search history.

(56) References Cited

U.S. PATENT DOCUMENTS 2,847,005 A 8/1958 Bourne
2,925,605 A 2/1960 Wheeler
3,263,681 A 8/1966 Nechtow et al.
3,263,682 A * 8/1966 Rosenfield ..... 602/63
3,348,541 A 10/1967 Loebeck
4,694,508 A * 9/1987 Iriyama et al. ..... 2/21
4,733,410 A 3/1988 Glotkin
5,348,153 A * 9/1994 Cole ..... 206/361
5,640,713 A * 6/1997 Ping ..... 2/21
5,761,743 A 6/1998 Andrews et al.
5,954,245 A * 9/1999 Kluesner ..... 223/101
6,128,778 A * 10/2000 Castagneri ..... 2/21
6,243,868 B1 6/2001 Wanzenried

* cited by examiner

*Primary Examiner*—Tejash Patel
(74) *Attorney, Agent, or Firm*—Ruden McClosky; James David Johnson

(57) ABSTRACT

An absorbent protective finger cover to be worn by aestheticians to protect the surface of their skin while performing facial extractions. The finger cover comprises an inner sheath of protective elastomer material and an outer layer of absorbent material attached to the inner protective sheath. An additional piece of absorbent material is disposed at a finger tip portion of the finger cover between the protective sheath and absorbent layer to provide additional absorbency for body fluids produced during the facial extraction.

14 Claims, 1 Drawing Sheet

AESTHETICIAN'S ABSORBENT FINGER COVER

BACKGROUND OF THE INVENTION

1. Field of the Invention

This invention relates to an absorbent finger cover or cot having an absorbent gauze layer and a protective barrier material sheath for wearing by aestheticians while performing facial extractions.

2. Description of Related Art

Finger cots, or finger covers, are worn by aestheticians performing facial extractions to protect the fingers from contact with the skin and bodily fluids of individuals receiving the facial extraction of blackheads, whiteheads, and the like. A typical finger cot is constructed from latex molded into the shape of a human finger or thumb. The latex acts as a protective barrier to prevent exposure to and infection with potential pathogens, such as bacteria, viruses, and funguses, on the skin and in bodily fluids of the aesthetician's client. Currently, aestheticians hold a piece of cotton gauze between one or more of the fingers and the thumb to collect and absorb bodily fluids produced by the skin of the client during the facial extraction process. Grasping the gauze with the finger is often awkward and difficult to hold while performing the extraction. Loose edges of the piece of gauze may also tickle or irritate the skin of the client causing the skin to itch.

The current invention provides a multiple layer finger cover to protect the wearer's fingers from exposure and contact with the skin and bodily fluids of the individual receiving the facial extraction while also permitting the collection and absorption of the bodily fluids with cotton gauze without tickling or irritating the skin of said individual. The inventive finger cover includes an inner sheath of protective material and an outer layer of absorbent material. The outer layer of absorbent material eliminates the need for holding or grasping a separate piece of cotton gauze while performing the facial extraction.

U.S. Pat. No. 2,847,005, issued to Bourne on Aug. 12, 1958, describes a surgical dressing for forming a finger cot to be worn over an injured finger. The Bourne invention is not directed toward an absorbent and protective finger cover worn by aestheticians performing facial extractions and does not include any additional absorbent material disposed between an inner protective layer and an outer absorbent layer.

U.S. Pat. No. 2,925,605, issued to Wheeler on Feb. 23, 1960, describes a finger cot having a moccasin-type construction. The stitching of the moccasin construction of the Wheeler finger cot could permit entry of another person's body fluids into the finger cot, thereby placing the finger cot wearer at risk of infection. The present invention does not use stitching and includes a protective layer that surrounds the finger of the wearer to protect from contact with body fluids of another.

U.S. Pat. No. 3,263,681, issued to Nechtow et al., on Aug. 2, 1966, describes a traction finger cot to provide a surgeon's finger traction during surgical examination and dissection. The Nechtow invention is designed to be worn over one finger of a surgeon's gloved hand to prevent slippage of the finger. The present invention is constructed to absorb and collect bodily fluids produced during facial extractions and to protect the aesthetician's finger from contact with the skin and bodily fluids of the client. The Nechtow invention is not designed to absorb bodily fluids and is not for use by an aesthetician performing facial extractions.

U.S. Pat. No. 3,348,541, issued to Loebeck on Oct. 24, 1967, describes a finger bandage having an adhesive strip for holding the bandage on the finger of the wearer. The bandage does not include absorbent material on the outer surface to absorb the bodily fluids of an individual other than the wearer.

U.S. Pat. No. 4,733,410, issued to Glotkin on Mar. 29, 1988, describes a finger cot construction that is a tubular, knit, finger-shaped piece having a closed end with a transverse seam. The Glotkin invention is comprised of cotton yarn and does not include a protective layer of material or any additional pieces of absorbent material.

U.S. Pat. No. 5,761,743, issued to Andrews et al., on Jun. 9, 1998, describes a finger cot intended for surgical use having seams and lacking any additional pieces of absorbent material for absorbing and collecting bodily fluids produced by the skin during a facial extraction.

U.S. Pat. No. 6,243,868, issued to Wanzenried on Jun. 12, 2001, describes a finger tip protector that does not include any absorbent material for collecting bodily fluids produced by the skin when an aesthetician performs a facial extraction for a client.

SUMMARY OF THE INVENTION

The invention is an absorbent protective finger cover comprising a sheath of protective barrier material, a layer of absorbent material, and a tip piece of an absorbent material. The finger cover is worn by aestheticians while performing facial extractions or other procedures during which the aesthetician's finger may contact the client's skin and bodily fluids. Both the sheath of protective barrier material and the layer of absorbent material include an open end and a closed end and are shaped to receive and cover a human finger. The layer of absorbent material is attached securely over an exterior surface of the sheath of protective barrier material and is shaped and sized to fit snugly over and around the sheath of protective barrier material. The tip piece of absorbent material is disposed at the closed end of said finger cover to provide additional absorption capacity to said finger cover.

The sheath of protective barrier material prevents contact between the aesthetician's skin and the skin and bodily fluids of an individual undergoing the facial extraction. The sheath of protective barrier material is comprised of an elastomer material, and preferably of latex. The layer of absorbent material and the tip piece of absorbent material collect and absorb bodily fluid produced by the skin of the individual undergoing the facial extraction. The absorbent material from which the layer of absorbent material and the tip piece of absorbent material are constructed is preferably a natural cotton gauze.

The tip piece of absorbent is disposed at the closed end of said finger cover between the sheath of protective barrier material and the layer of absorbent material. The tip piece provides the aesthetician or other wearer with additional absorbency to collect bodily fluids produced by an individual's skin while undergoing a facial extraction. The layer of absorbent material is attached securely to the exterior surface of the sheath of protective barrier material using an adhesive. Said finger cover is preferably sized and shaped to fit over and around the distal phalanx of the finger. The finger cover is manufactured in two shapes: one shape to fit over and around the thumb and a second shape to fit over and around any of the other fingers of the wearer.

An object of the invention is to provide a protective finger cover to be worn over the fingers to prevent contact with and exposure to potential pathogens.

Another object of the invention is to provide a protective finger cover that also includes absorption capacity to absorb and collect bodily fluids from the surface of the skin.

Still another object of the invention is to provide aestheticians with a protective and absorbent finger cover to be worn while performing facial extractions of blackheads, whiteheads, other pore plugs and skin lesions.

In accordance with these and other objects which will become apparent hereinafter, the instant invention will now be described with particular reference to the accompanying drawings.

DETAILED DESCRIPTION

Figure 1:
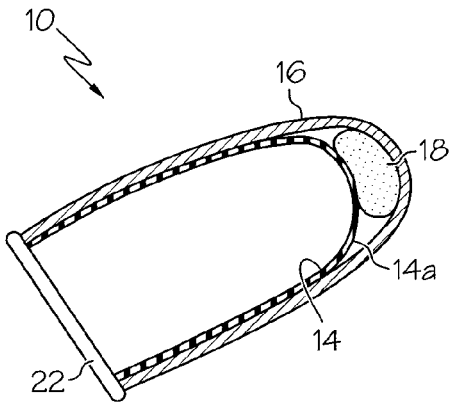
FIG. 1 shows a cross-sectional side perspective view of the absorbent finger cover.
Figure 2:
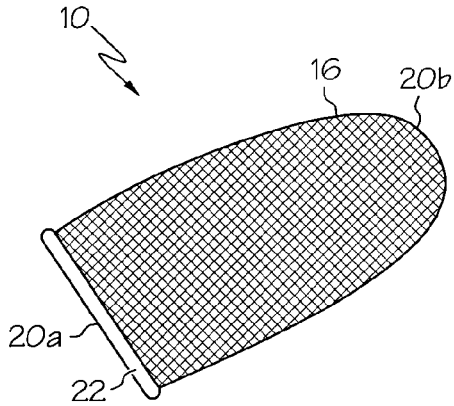
FIG. 2 shows a side perspective view of the absorbent finger cover.
Figure 3:
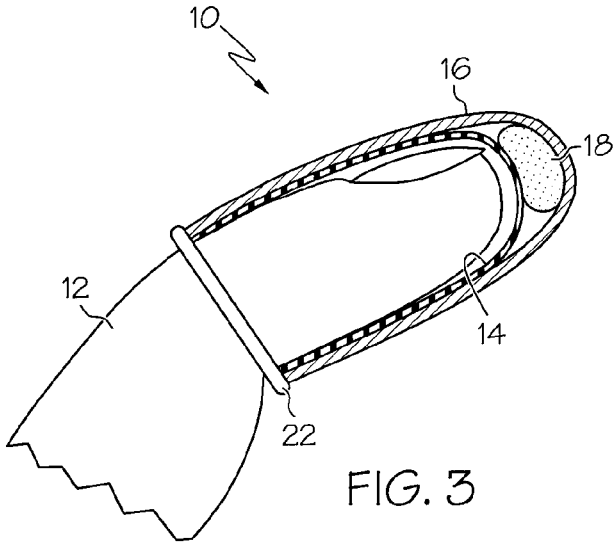
FIG. 3 shows a cut-away perspective view of a human finger inserted into the absorbent finger cover.

The invention 10, as illustrated in FIGS. 1 and 2, is an absorbent protective finger cover 10 to be worn by aestheticians over a finger 12 while performing facial extractions or other procedures during which the aesthetician's finger may contact the client's skin and bodily fluids. The finger cover 10 comprises a sheath of protective barrier material 14, a layer of absorbent material 16, and a tip piece 18 of an absorbent material. The sheath of protective barrier material 14 includes an open end 20*a* and a closed end 20*b* and is shaped to receive and cover a human finger as shown in FIG. 3. The layer of absorbent material 16 is attached securely over an exterior surface 14*a* of the sheath of protective barrier material 14 and is shaped and sized to fit snugly over and around the sheath of protective barrier material 14. The tip piece 18 of absorbent material is located at the closed end 20*b* of said finger cover 10 to provide additional absorption capacity to said finger cover. The finger cover 10 is designed for wearing and use by an aesthetician to perform facial extractions of blackheads and whiteheads.

The sheath of protective barrier material 14 prevents contact between the aesthetician's skin and the skin and bodily fluids of an individual undergoing the facial extraction. Said sheath of protective barrier material 14 is an elastomer material, such as latex. The layer of absorbent material 16 and the tip piece 18 of absorbent material collect and absorb bodily fluid produced by the skin of the individual undergoing the facial extraction. The layer of absorbent material 16 and the tip piece 18 of absorbent material may consist of identical materials or of different materials. Preferably, the absorbent material from which the layer of absorbent material and the tip piece of absorbent material are manufactured is selected from one or more of the following materials: cotton or polymer gauze, natural or synthetic cloth fabric, cotton ball material, or combinations, blends, or multiple layers of any of these absorbent materials.

The tip piece 18 of absorbent material is disposed at the closed end 20*b* of said finger cover 10 between the sheath of protective barrier material 14 and the layer of absorbent material 16. The tip piece 18 provides the aesthetician or other wearer with additional absorbency to collect bodily fluids produced by an individual's skin while undergoing a facial extraction. In the preferred embodiment of the invention, the layer of absorbent material 16 is attached securely to the exterior surface 14*a* of the sheath of protective barrier material 14 using an adhesive (not shown in the drawings). However, other means for firmly engaging the absorbent layer 16 and the protective sheath 14 may be employed, including securely attaching the layer of absorbent material 16 to the exterior surface 14*a* of the sheath of protective barrier material 14 by rolling said absorbent material layer into a cuff 22 surrounding the open end 20*a* of the protective barrier material sheath 14.

In one embodiment of the invention, the open end 20*a* of the sheath of protective barrier material 14 includes an elastic portion (not shown in the drawings) sized slightly smaller than the finger 12. Said elastic portion enables the sheath of protective material and layer of absorbent material around the open end of the finger cover to expand, thereby permitting entry of the finger into the finger cover and allowing said open end to contract to fit snugly around the finger of the wearer.

The finger cover 10 is preferably sized and shaped to fit over and around the distal phalanx of the finger, however, said finger cover may be manufactured in lengths and shapes to fit over and around the finger up to the middle or even proximal phalanges. Preferably, finger covers are worn by the aesthetician over the index finger and thumb. Said finger cover is manufactured in various sizes, but preferably in standard small, medium, and large sizes to accommodate the varying diameters and lengths the fingers of different wearers. The finger cover is manufactured in two shapes: one shape to fit over and around any of the index finger, middle finger, ring finger, or little finger of the wearer and in another shape to fit over and around the thumb of the wearer.

In the preferred embodiment of the invention, the finger cover is manufactured in a shape and dimensions to fit over and around the distal phalanx of the finger of the wearer. However, said finger cover may also be manufactured in a shape and dimensions to fit over and around the finger extending up to the middle phalanx or proximal phalanx of the finger over which the finger cover is worn. While designed for use by aestheticians or dermatologists performing facial extractions upon individuals, the finger cover can be worn and used by any person in need of protecting their fingers while taking advantage of the absorption capabilities of said finger cover. The shape and design of the finger cover is flexible and does not restrict the use or movement of the finger.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An absorbent protective finger cover consisting essentially of:

a first generally tubular sheath shaped and sized to cover only a human finger;

wherein the first generally tubular sheath comprises a protective barrier material and further comprises an open end and a closed end;

a second generally tubular sheath comprising an absorbent material attached securely over and an exterior surface of the first generally tubular sheath and shaped and sized to fit snugly over and around said first generally tubular sheath;

and a discrete tip piece of absorbent material for providing additional absorption capacity to the finger cover;

wherein the discrete tip piece of absorbent material is disposed solely at the closed end of said finger cover between said first generally tubular sheath and said second generally tubular sheath.

2. The finger cover of claim 1, wherein said finger cover is designed for wearing and use by an aesthetician or a dermatologist to perform facial extractions of blackheads, whiteheads, and other fluids and materials in skin lesions and pore plugs;

wherein the first generally tubular sheath prevents contact between the aesthetician's skin and the skin and bodily fluids of an individual undergoing the facial extraction; and wherein the second generally tubular sheath and the tip piece of absorbent material collect and absorb bodily fluid produced by the skin of the individual undergoing the facial extraction.

3. The finger cover of claim 1, wherein the first generally tubular sheath comprises is an elastomer material, such as latex.

4. The finger cover of claim 1, wherein the second generally tubular sheath and the tip piece of absorbent material consist of identical materials.

5. The finger cover of claim 1, wherein the second generally tubular sheath and the tip piece of absorbent material consist of different materials.

6. The finger cover of claim 1, wherein the absorbent material from which the second generally tubular sheath and the tip piece of absorbent material are manufactured is selected from one or more of the following: cotton or polymer gauze, natural or synthetic cloth fabric, cotton ball material, or combinations, blends, or multiple layers of any of these absorbent materials.

7. The finger cover of claim 1, wherein the second generally tubular sheath is attached securely to the exterior surface of the first generally tubular sheath using an adhesive.

8. The finger cover of claim 1, wherein the second generally tubular sheath is attached securely to the exterior surface of the first generally tubular sheath by rolling the absorbent material of the second generally tubular sheath into a cuff surrounding the open end of the first generally tubular sheath.

9. The finger cover of claim 1, wherein the open end of the first generally tubular sheath includes an elastic portion sized slightly smaller than the finger and capable of expanding to permit entry of the finger into the finger cover and to contract to fit snugly around the finger of the wearer.

10. The finger cover of claim 1, wherein said finger cover is manufactured in various sizes, but preferably in standard small, medium, and large sizes to accommodate the varying finger diameters and lengths of different wearers.

11. The finger cover of claim 1, wherein said finger cover is manufactured in one shape to fit over and around any of the index finger, middle finger, ring finger, or little finger of the wearer and is manufactured in another shape to fit over and around the thumb of the wearer.

12. The finger cover of claim 1, wherein said finger cover is manufactured preferably in a shape and dimensions to fit over and around the distal phalanx of the finger of the wearer.

13. The finger cover of claim 1, wherein said finger cover is manufactured in a shape and dimensions to fit over and around the finger extending up to the middle phalanx or proximal phalanx of the finger over which the finger cover is worn.

14. The finger cover of claim 1, wherein said finger cover is designed for wearing and use by an individual to protect the finger from contact with possible pathogens or irritants;

wherein the first generally tubular sheath prevents contact between the individual's skin and the possible pathogens or irritants; and wherein the second generally tubular sheath and the tip piece of absorbent material collect and absorb fluids.

* * * * *